US010116089B1

(12) United States Patent
Hu et al.

(10) Patent No.: US 10,116,089 B1
(45) Date of Patent: Oct. 30, 2018

(54) CONNECTOR PROOFED AGAINST NON-INTENTIONAL DISCONNECTION

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Lei Hu, Shenzhen (CN); Xin Yang, Shenzhen (CN); Wen-Jun Zhong, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/677,799

(22) Filed: Aug. 15, 2017

(30) Foreign Application Priority Data

Jun. 6, 2017 (CN) ..... 2017 1 0420273

(51) Int. Cl.
*H01R 13/62* (2006.01)
*H01R 13/639* (2006.01)

(52) U.S. Cl.
CPC ..... *H01R 13/6205* (2013.01); *H01R 13/639* (2013.01)

(58) Field of Classification Search
CPC .. H01R 13/639; H01R 13/6205; H01R 13/62; H01R 13/4361; H01R 11/30
USPC ..... 439/38, 39, 347, 668, 315
See application file for complete search history.

(56) References Cited

U.S. PATENT DOCUMENTS 4,843,477 A * 6/1989 Mizutani ..... B60R 11/0235 312/7.2
5,641,299 A * 6/1997 Meguro ..... H01R 13/639 439/347
6,528,746 B2 * 3/2003 DeWitt ..... H01R 13/701 200/51.09
7,364,452 B2 * 4/2008 Carver ..... H01R 43/26 439/310
7,950,943 B2 * 5/2011 Ohtomo ..... B60L 11/1803 439/299
8,022,664 B2 * 9/2011 Shu ..... B25J 19/005 320/107
8,900,006 B2 * 12/2014 Gaul ..... B60L 11/1818 439/489
8,951,060 B2 * 2/2015 Meyer-Ebeling .... H01R 13/639 320/109

(Continued)

*Primary Examiner* — Tulsidas C Patel
*Assistant Examiner* — Marcus Harcum
(74) *Attorney, Agent, or Firm* — ScienBiziP, P.C.

(57) ABSTRACT

A connector proofed against accidental disengagement is disclosed. The connector includes a socket. The socket has a base, at least one magnetic member with a pawl, at least one energized coil assembly, and a sensor. The base has a hole. The magnetic member and the energized coil assembly are disposed in the base with the sensor. When a plug is inserted into the hole of the base of the socket, the sensor can recognize the plug being inserted into the hole of the base and the energized coil assembly can be energized to cause the pawl of the magnetic member to engage and lock the plug in place. The connection remains until the energized coil assembly causes the pawl to disengage, allowing separation of the plug from the socket.

16 Claims, 4 Drawing Sheets

(56) References Cited

U.S. PATENT DOCUMENTS

| | | | | |
|---|---|---|---|---|
| 8,956,173 | B2 * | 2/2015 | Pomerantz | G06F 21/44<br>439/347 |
| 2013/0010378 | A1 * | 1/2013 | Wang | G02B 7/08<br>359/824 |

* cited by examiner

CONNECTOR PROOFED AGAINST NON-INTENTIONAL DISCONNECTION

CROSS REFERENCE TO RELATED APPLICATION

This application claims priority to Chinese Patent Application No. 201710420273.5, filed Jun. 6, 2017, the disclosure of which is incorporated herein by reference in its entirety.

FIELD

The present disclosure relates to connectors, and more particularly to a connector for preventing a plug from being inadvertently pulled out of a socket.

BACKGROUND

Outdoor activities, such as running, biking, etc., have become an indispensable part of many people's lives. People often use electronic devices during these outdoor activities. For example, a runner listens to music through an earphone connected to an electronic device, and a biker connects an electronic device to a bicycle generator to recharge the electronic device. The electronic device is connected to other devices through a connector using friction or magnetic force. However, when the electronic device is in motion, the connector using friction or magnetic force may not provide a stable connection, thereby resulting in a high risk of disconnection and losing the electronic device.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
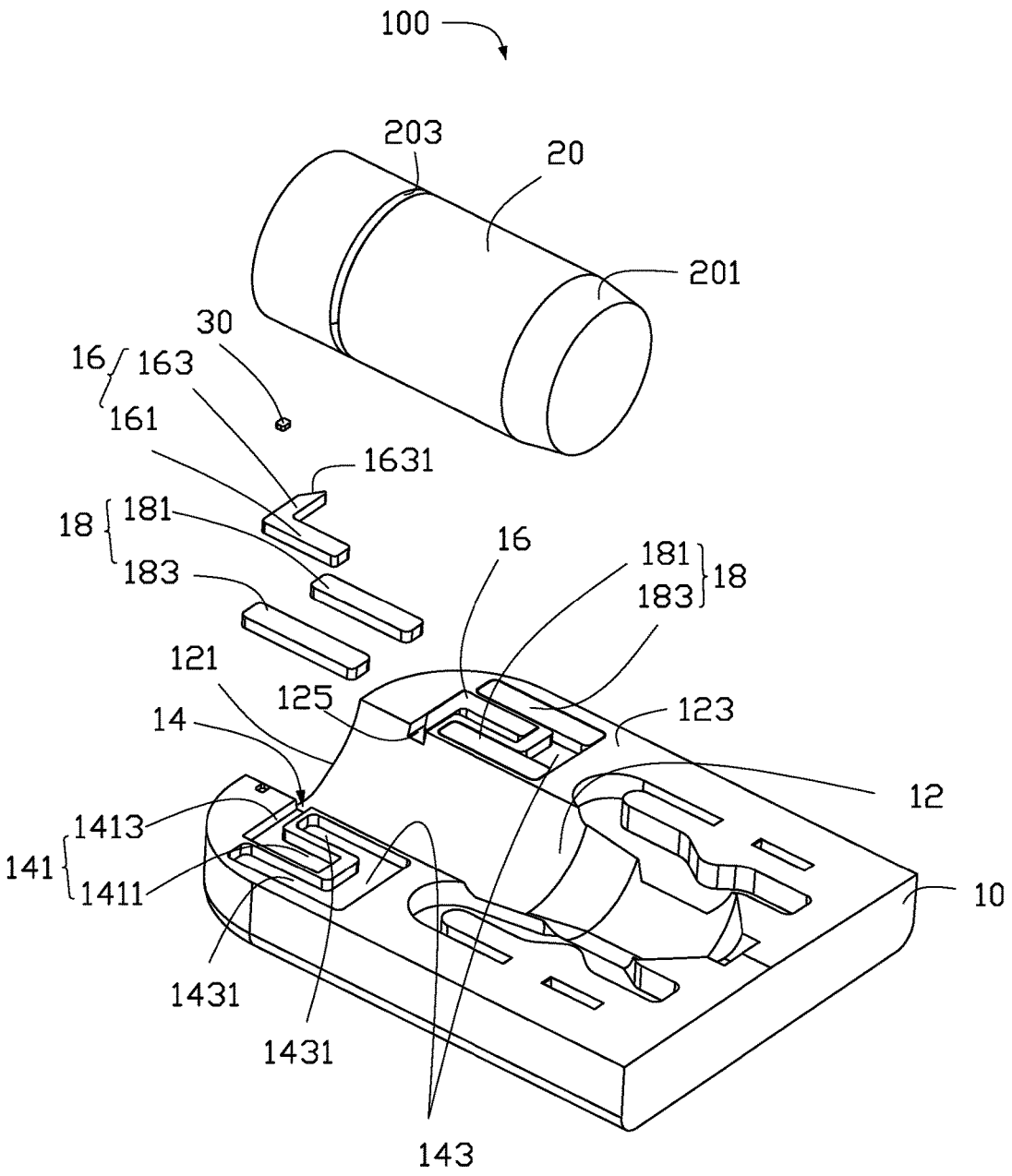
FIG. 1 is a schematic exploded perspective view of a connector.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" means "including but not limited to"; it specifically indicates open-ended inclusion or membership in the so-described combination, group, series, and the like.

With reference to FIG. 1, an exemplary embodiment of a connector 100 includes a socket 10 and a plug 20.

The socket 10 is partially shown, and includes a base 123, at least one magnetic member 16, at least one energized coil assembly 18, and a sensor 30. The base 123 has a central portion, a peripheral portion, a hole 12, and at least one recess portion 14. The hole 12 is formed in the central portion of the base 123, and is provided for receiving the plug 20. The hole 12 has an inlet end 121. The at least one recess portion 14 is formed in the peripheral portion of the base 123. The magnetic member 16 and the energized coil assembly 18 are disposed in the at least one recess portion 14, and the magnetic member 16 is movable in the recess portion 14 toward and away from the hole 12. The sensor 30 is mounted in the base 123, and is adjacent to the inlet end 121 of the hole 12 of the base 123. The sensor 30 can detect the insertion of the plug 20 into the hole 12, and the energized coil assembly 18 can be energized to generate an electromagnetic force so as to cause the magnetic member 16 to engage the plug 20, thereby connecting the plug 20 to the socket 10.

In the present exemplary embodiment, two recess portions 14 are disposed on opposite sides of the hole 12 of the base 123, and one magnetic member 16, and one energized coil assembly 18 are mounted in each of the recess portions 14. Each recess portion 14 has a first recess 141 and a second recess 143. The first recess 141 is L-shaped, and has a long part 1411 and a short part 1413. The short part 1413 is adjacent to the inlet end 121 of the hole 12. An opening 125 is disposed at an end of the short part 1413, and communicates with the hole 12. The magnetic member 16 is disposed in the first recess 141. The magnetic member 16 is L-shaped, and has a long leg 161 and a short leg 163. The long leg 161 is disposed in the long part 1411 of the first recess 141. The short leg 163 is disposed in the short part 1413 of the first recess 141. A pawl 1631 is formed on an end of the short leg 163, and is adjacent to the opening 125 of the first recess 141. The second recess 143 is U-shaped, and has two parallel parts 1431. The parallel parts 1431 are disposed on opposite sides of the long part 1411 of the first recess 141. One of the parallel parts 1431 is adjacent to the hole 12, and the other parallel part 1431 is away from the hole 12. The energized coil assembly 18 is disposed in the second recess 143, and has a first energized coil 181 and a second energized coil 183. The first energized coil 181 is disposed in the parallel part 1431 of the second recess 143 that is adjacent to the hole 12, and the second energized coil 183 is disposed in the parallel part 1431 of the second recess 143 that is away from the hole 12. The first energized coil 181 can be energized to generate an electromagnetic force when the plug 20 is inserted into the hole 12 of the base 123 to cause the pawl 1631 of the magnetic member 16 to protrude from the opening 125 of the first recess 141 into the hole 12 of the base 123. The second energized coil 183 can be energized to generate an electromagnetic force when the plug 20 is removed from the hole 12 of the base 123 to retract the pawl 1631 of the magnetic member 16 from the opening 125 of the first recess 141 into the short part 1413 of the first recess 141. The first energized coil 181 and the second energized coil 183 work alternately, such that the second energized coil 183 stops being energized when the first energized coil 181 generates the electromagnetic force, and the first energized coil 181 stops being energized when the second energized coil 183 generates the electromagnetic force. As a result, the magnetic member 16 is moveable in the recess portion 14 by a single electromagnetic force at one time.

The plug 20 is inserted into the hole 12 of the base 123 of the socket 10 through the inlet end 121 of the hole 12. The plug 20 includes two ends, with one end of the plug 20 having a tapered portion 201, and the other end of the plug 20 having an annular groove 203. The pawl 1631 of the magnetic member 16 selectively engages the groove 203 to connect the plug 20 to the socket 10.

The control of the energizing and de-energizing of the first energized coil 181 and the second energized coil 183 is carried out by an electronic device connected to the connector 100 of the present disclosure. The control by the electronic device is conventional and is not a technical feature of the present disclosure, thus a detailed description thereof will be omitted.

When the plug 20 is inserted into the hole 12 of the base 123 of the socket 10 through the inlet end 121 of the hole 12, the sensor 30 detects instantly without delay that the plug 20 is being inserted into the hole 12. The first energized coil 181 is energized to generate an electromagnetic force. The electromagnetic force of the first energized coil 181 attracts the magnetic member 16 to move toward the hole 12, and causes the pawl 1631 of the magnetic member 16 to protrude from the opening 125 of the first recess 141 and into the hole 12. The pawl 1631 of the magnetic member 16 does not obstruct the insertion of the plug 20 because the tapered portion 201 of the plug 20 can push the pawl 1631 of the magnetic member 16 into the short part 1413 of the first recess 141 so as to resist the electromagnetic force of the first energized coil 181.

Figure 2:
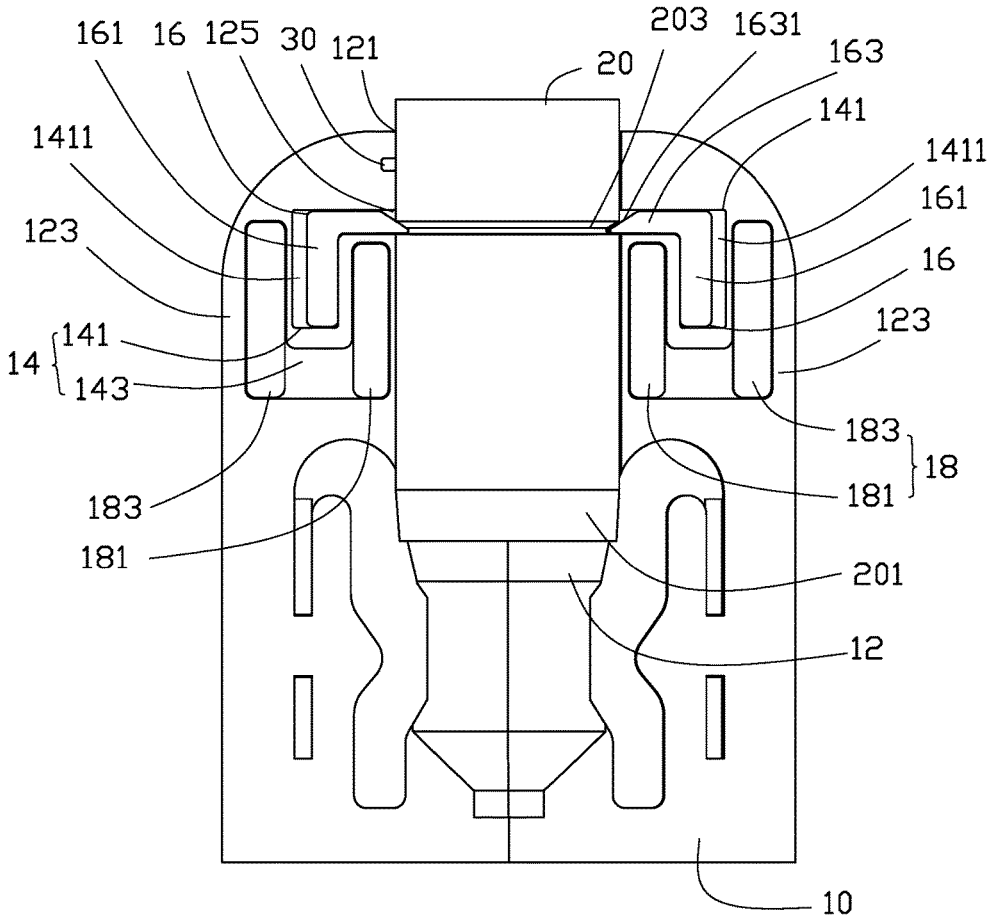
FIG. 2 is a schematic top view of the connector of FIG. 1 showing a plug being held in a socket.

When the plug 20 is fully inserted into the socket 10, the electromagnetic force of the first energized coil 181 continues to act on the magnetic member 16 such that the pawl 1631 of the magnetic member 16 continues to protrude from the opening 125 of the first recess 141. With reference to FIG. 2, when the plug 20 is fully inserted into the socket 10 to cause the groove 203 of the plug 20 to correspond to (e.g., align with) the opening 125 of the first recess 141, the pawl 1631 of the magnetic member 16 protrudes from the opening 125 of the first recess 141 to engage the groove 203 of the plug 20. The electromagnetic force of the first energized coil 181 continues to act on the magnetic member 16 such that the pawl 1631 of the magnetic member 16 continues to engage the groove 203 of the plug 20. The engagement between the pawl 1631 of the magnetic member 16 and the groove 203 of the plug 20 provides a locked and stable connection between the plug 20 and the socket 10, and effectively prevents the plug 20 from accidentally being pulled out of the hole 12 of the base 123 of the socket 10. In the present exemplary embodiment, the two magnetic members 16 are disposed on opposite sides of the plug 20 such that the two magnetic members 16 can engage opposite sides of the groove 203 of the plug 20 and thereby providing a balanced locking function.

Figure 3:
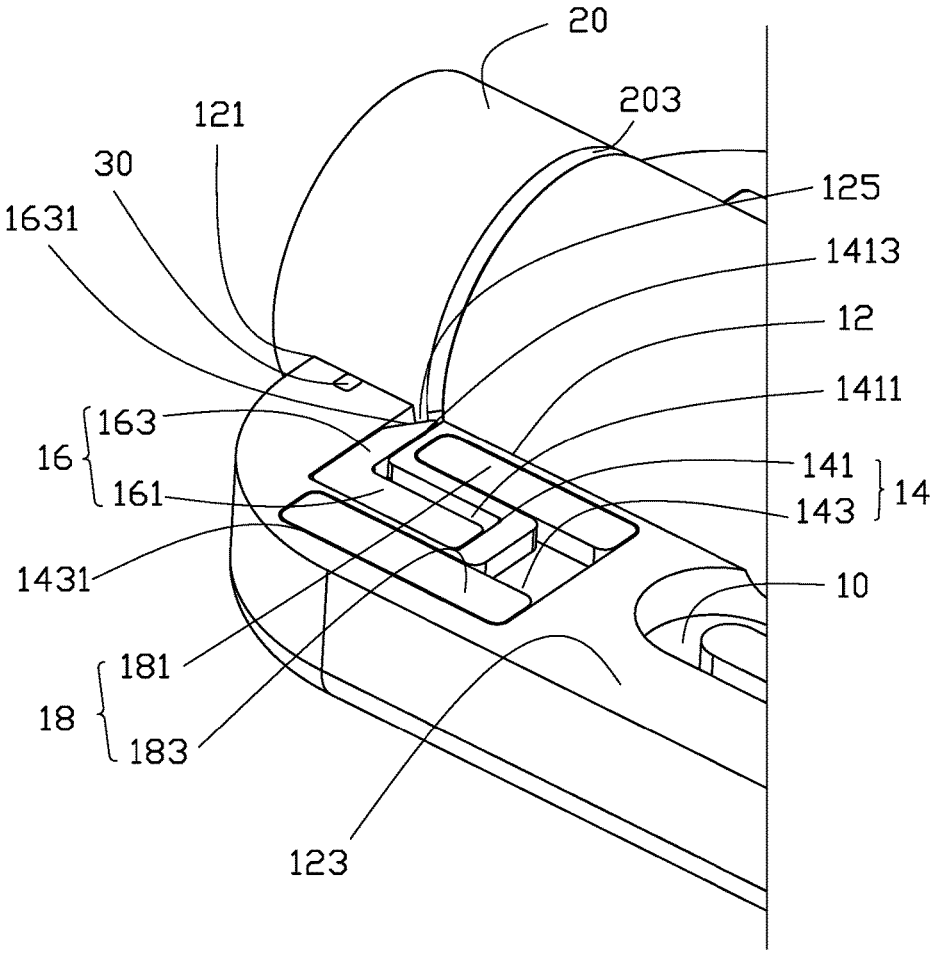
FIG. 3 is an enlarged schematic perspective view of a portion of the connector of FIG. 1 showing a magnetic member disengaging from the plug.
Figure 4:
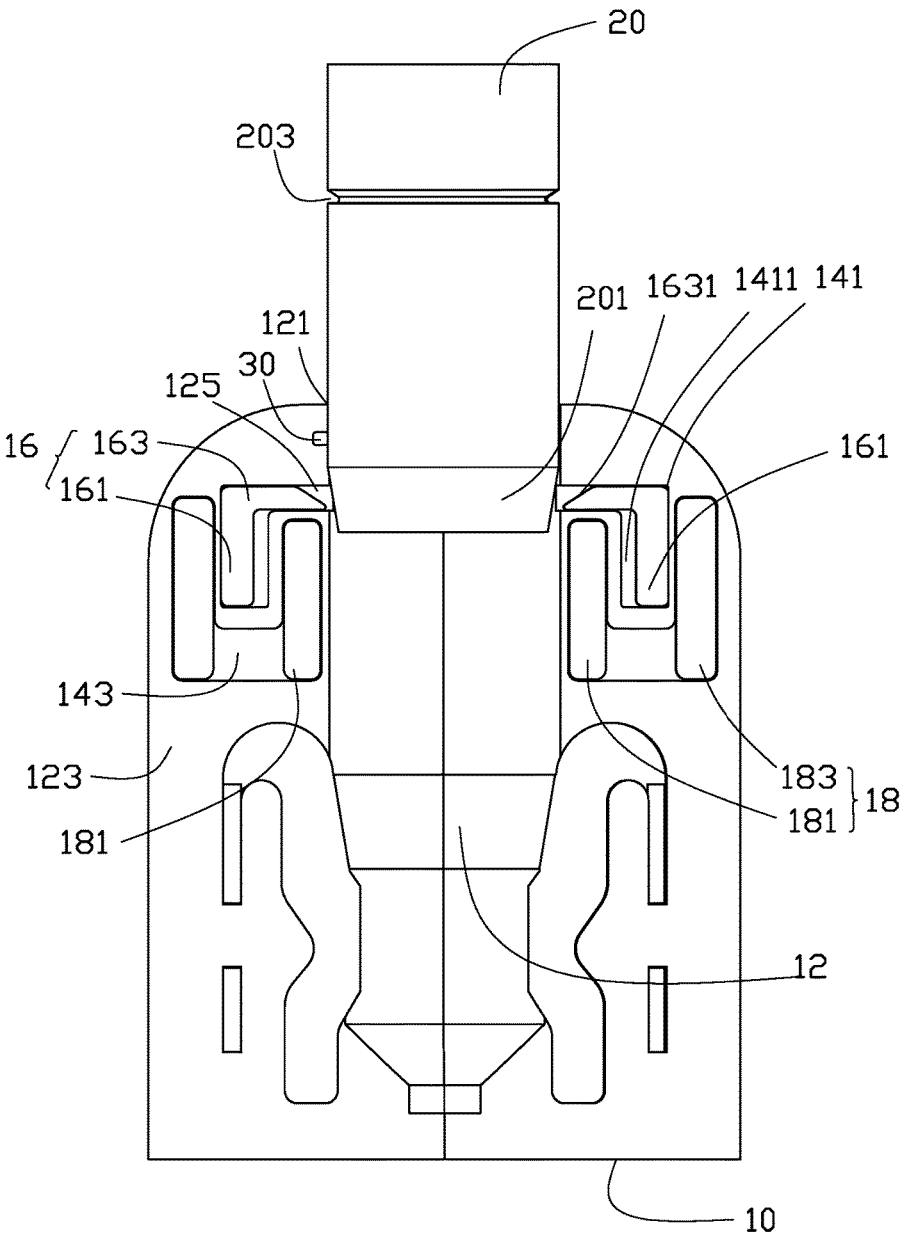
FIG. 4 is a schematic top view of the connector of FIG. 1 showing the plug being removed from the socket.

When the plug 20 is desired to disengage the socket 10, the second energized coil 183 is controlled to be energized to generate the electromagnetic force, and the first energized coil 181 stops being energized. With reference to FIG. 3, the electromagnetic force of the second energized coil 183 attracts the magnetic member 16 to move away from the hole 12 of the base 123 to cause the pawl 1631 of the magnetic member 16 to retract from the opening 125 of the first recess 141 so as to disengage from the groove 203 of the plug 20. With reference to FIG. 4, the engagement between the socket 10 and the plug 20 is released when the pawl 1631 of the magnetic member 16 disengages from the groove 203 of the plug 20, thus the plug 20 can be easily removed from the socket 10.

The exemplary embodiments shown and described above are only examples. Many details are often found in the art such as the other features of a connector. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. A connector comprising:

a socket having:

a base having:

a hole formed in the base, the hole having an inlet end; and at least one peripheral recess portion formed in the base;

at least one magnetic member disposed in the recess portion of the base;

at least one energized coil assembly disposed in the recess portion of the base; and a sensor in the base adjacent to the inlet end of the hole of the base;

wherein the sensor is used to detect that a plug is being inserted into the hole of the base of the socket through the inlet end, and the energized coil assembly generates an electromagnetic force so as to cause the at least one magnetic member to engage the plug, thereby connecting the plug to the socket;

wherein the recess portion of the base has a first recess; and a second recess having two parallel parts disposed on opposite sides of the first recess;

wherein the magnetic member is disposed in the first recess; and wherein the energized coil assembly has a first energized coil disposed in the parallel part of the second recess which is adjacent to the hole of the base; and a second energized coil disposed in the parallel part of the second recess which is away from the hole of the base.

2. The connector of claim 1, wherein the first recess is L-shaped, and has a long part;

a short part adjacent to the hole; and an opening at an end of the short part.

3. The connector of claim 2, wherein the at least one magnetic member is L-shaped, and has a long leg;

a short leg; and a pawl on an end of the short leg being adjacent to the opening of the first recess.

4. The connector of claim 2, wherein the two parallel parts of the second recess are disposed on opposite sides of the long part of the first recess.

5. The connector of claim 3, wherein the two parallel parts of the second recess are disposed on opposite sides of the long part of the first recess.

6. The connector of claim 1, wherein the first energized coil is energized to generate an electromagnetic force when the plug is inserted into the hole of the base to cause the at least one magnetic member to protrude from the first recess and dispose in the hole, and the second energized coil is energized to generate an electromagnetic force when the plug is removed from the hole of the base to cause the at least one magnetic member to retract into the first recess.

7. The connector of claim 4, wherein the first energized coil is energized to generate an electromagnetic force when the plug is inserted into the hole of the base to cause the at least one magnetic member to protrude from the opening of the first recess and dispose in the hole, and the second energized coil is energized to generate an electromagnetic force when the plug is removed from the hole of the base to cause the at least one magnetic member to retract into the first recess.

8. The connector of claim 5, wherein the first energized coil is energized to generate an electromagnetic force when the plug is inserted into the hole of the base to cause the pawl of the at least one magnetic member to protrude from the opening of the first recess into the hole, and the second energized coil is energized to generate an electromagnetic force when the plug is removed from the hole of the base to cause the pawl of the at least one magnetic member to retract into the first recess.

9. The connector of claim 6, wherein the second energized coil stops being energized when the first energized coil generates the electromagnetic force, and the first energized coil stops being energized when the second energized coil generates the electromagnetic force, such that the at least one magnetic member is moved by a single electromagnetic force at a time.

10. The connector of claim 7, wherein the second energized coil stops being energized when the first energized coil generates the electromagnetic force, and the first energized coil stops being energized when the second energized coil generates the electromagnetic force, such that the at least one magnetic member is moved by a single electromagnetic force at a time.

11. The connector of claim 8, wherein the second energized coil stops being energized when the first energized coil generates the electromagnetic force, and the first energized coil stops being energized when the second energized coil generates the electromagnetic force, such that the at least one magnetic member is moved by a single electromagnetic force at a time.

12. The connector of claim 1, wherein the plug comprises:

two ends;

a tapered portion at one of the ends of the plug; and a groove at another one of the ends of the plug; and wherein the at least one magnetic member selectively engages the groove of the plug.

13. The connector of claim 2, wherein the plug comprises:

two ends;

a tapered portion at one of the ends of the plug; and a groove at another one of the ends of the plug; and wherein the at least one magnetic member selectively engages the groove of the plug.

14. The connector of claim 3, wherein the plug comprises:

two ends;

a tapered portion at one of the ends of the plug; and a groove at another one of the ends of the plug; and wherein the at least one magnetic member selectively engages the groove of the plug.

15. The connector of claim 12, wherein the tapered portion of the plug is able to push the at least one magnetic member when the plug is inserted into the hole of the base of the socket.

16. The connector of claim 13, wherein the tapered portion of the plug is able to push the at least one magnetic member when the plug is inserted into the hole of the base of the socket.

* * * * *